United States Patent [19]

Baumann et al.

[11] 4,290,112

[45] Sep. 15, 1981

[54] METHOD AND APPARATUS FOR ELECTRO-OPTICALLY CONVOLUTING A ONE-DIMENSIONAL SIGNAL

[75] Inventors: Jacob S. Baumann, Pynacker; Ronald J. Geluk, Nootdorp, both of Netherlands

[73] Assignee: N.V. Optische Industrie "De Oude Delft", Netherlands

[21] Appl. No.: 36,097

[22] Filed: May 4, 1979

[30] Foreign Application Priority Data

May 5, 1978 [NL] Netherlands ..... 7804881

[51] Int. Cl.[3] ..... G06G 7/19; G06G 9/00

[52] U.S. Cl. ..... 364/822; 250/445 T; 364/414; 364/861

[58] Field of Search ..... 364/819, 822, 713, 820, 364/821; 350/162 SF, 358; 250/445 T, 445 R

[56] References Cited

U.S. PATENT DOCUMENTS

| | | | |
|---|---|---|---|
| 3,088,113 | 4/1963 | Rosenthal | 364/822 X |
| 3,441,724 | 4/1969 | Taylor, Jr. | 364/713 |
| 4,012,120 | 3/1977 | Kagiwada et al. | 364/822 X |
| 4,039,815 | 8/1977 | Geluk | 364/822 |
| 4,071,907 | 1/1978 | Casasent | 364/822 |
| 4,097,898 | 6/1978 | Geluk | 358/163 |
| 4,107,701 | 8/1978 | Sprague et al. | 364/822 X |

*Primary Examiner*—Felix D. Gruber

*Attorney, Agent, or Firm*—Louis E. Marn; Elliot M. Olstein

[57] ABSTRACT

There is disclosed a method and apparatus for convoluting a signal representing a profile formed during X-ray tomography and a filter function wherein a one-dimensional image of the signal is expanded in a direction transverse to the line by means of an optical system whereby the expanded image is moved past masks in the direction of the line with the masks containing regions that are either fully transmissive or fully non-transmissive.

26 Claims, 10 Drawing Figures

METHOD AND APPARATUS FOR ELECTRO-OPTICALLY CONVOLUTING A ONE-DIMENSIONAL SIGNAL

FIELD OF THE INVENTION

The invention relates to a method for electro-optically convoluting a signal representing a profile formed during X-ray tomography and a filter function, in which the signal is electro-optically, one-dimensionally reproduced as a line along which the brightness varies and in which the filter function is laid down in one or more masks, a photodetector being mounted behind each mask for detecting the light transmitted by the masks when the one-dimensional image of the signal is moved past the masks, as well as to an apparatus for performing the method.

BACKGROUND OF THE INVENTION

U.S. application Ser. No. 795,238, filed May 9, 1977 and now U.S. Pat. No. 4,173,720 describes the manner in which, when forming a tomogram, a rotating body is irradiated by a flat X-ray beam so as to achieve a large number of linear X-ray shadowgraphs, the so-called profiles, from which the tomogram is constructed by back projection. For eliminating the effects of the filter function, in accordance with one of the methods described therein the profiles should be convoluted with a suitable filter function prior to the back projection. For this purpose, the profiles are successively reproduced on the anode of an image intensifier tube and the resultant image is moved by means of suitably energized deflection coils mounted around the image intensifier tube. The image of the profiles as moving over the anode is detected by a photomultiplier tube through a mask in which the filter function has photographically been laid down.

A drawback inherent in this known method is that it is rather difficult to realize a well-defined and reproducible transmission characteristic representing the filter function in the mask by means of photographic techniques.

SUMMARY OF THE INVENTION

The problem of the prior art is eliminated by a method and apparatus for convoluting a signal representing a profile formed during X-ray tomography and a filter function wherein the one-dimensional image of the signal is expanded in a direction transverse to the line by means of an optical system, wherein the expanded image is moved past the masks in the direction of the line with the masks only containing regions that are either fully transmissive or fully non-transmissive.

Furthermore, in accordance with the invention an apparatus for performing the method is characterized by an optical system preceding the mask and expanding the linear image in a direction transverse to the longitudinal direction.

BRIEF DESCRIPTION OF THE DRAWINGS

The invention will be described in greater detail hereinafter with reference to the accompanying drawings, in which.

DETAILED DESCRIPTION OF THE INVENTION

Figure 1:
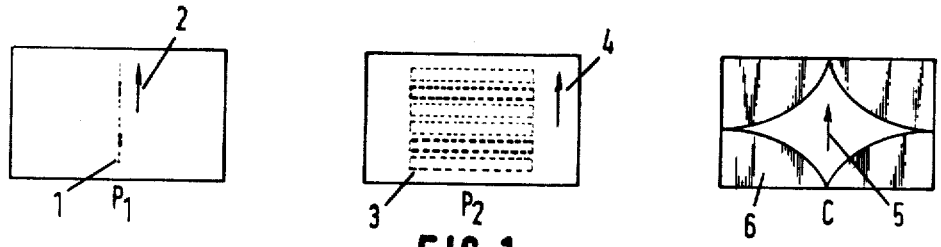
FIG. 1 schematically shows the successive steps of a method according to the invention.

In FIG. 1, in block $P_1$ the first step of the method according to the invention is shown. An image of a one-dimensional signal 1 is formed, the brightness of which varies in longitudinal direction in accordance with a predetermined function. If this signal 1 is a profile obtained when forming a tomogram, this brightness variation corresponds with the variation of the density of the body irradiated by a flat X-ray beam at the place of irradiation. In the following, the term "profile" will be used but it is observed that any one-dimensional signal function may be convoluted in the manner to be described.

The arrow 2 indicates that the profile is moved in longitudinal direction in order to permit the performance of the convolution by means of a stationary mask.

The block $P_2$ shows the second step of the method according to the invention, in which the profile 1 is expanded transversely to the longitudinal direction, so that a two-dimensional representation 3, which will be called "expanded profile" hereinafter, is achieved. Each vertical section of the expanded profile is equal to the original profile. Consequently, the second dimension does not contain additional information.

As profile 1 is moved in vertical direction, expanded profile 3 moves in vertical direction too, which is indicated by arrow 4. In principle, it is also possible that profile 1 is stationary while only expanded profile 3 is moved.

Block C shows the third step of the method according to the invention. During this step the desired convoluting operation takes place as the expanded profile 3 moving in the direction indicated by arrow 5 is detected through a stationary mask 6 representing the filter function in two-dimensional form. In the event of tomographic image construction, the mask represents a filter function that anticipates the effects of the point spread function, which filter function will be called "anticipation function" hereinafter.

It is observed that in theory the steps described need not be performed simultaneously; in that case, only the movement indicated by arrow 5 is required. In practice, however, the three steps in question will be performed simultaneously. In that case the movement of the profile of the expanded profile may be introduced during one of the steps.

Figure 6:
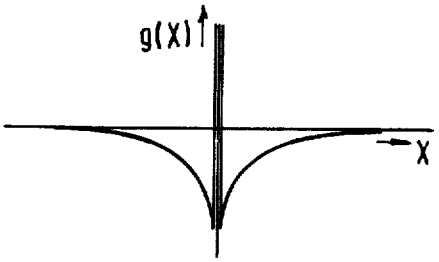
FIG. 6 shows a filter function.

As stated earlier, the mask represents the anticipation function in the event of tomographic image construction. This function may have the following form: $g(x)=\delta(x)-a/x^2$, in which $\delta(x)$ is the Dirac function, i.e. $\delta(x)=\infty$ when $x=0$ and $\delta(x)=0$ when $x\neq 0$. This function is shown in FIG. 6. As the function shown has positive as well as negative portions, this function has to be split up over two masks each having an associated light path and detector.

In accordance with the known method, the two masks should each contain a linear region along which the transmission value varies in accordance with the function shown in FIG. 6. The longitudinal direction of the linear region then corresponds with the x-axis of FIG. 6 and the transmission value with the associated value of the function g(x). The profile is moved in the direction of the x-axis along the linear region.

Figure 7:
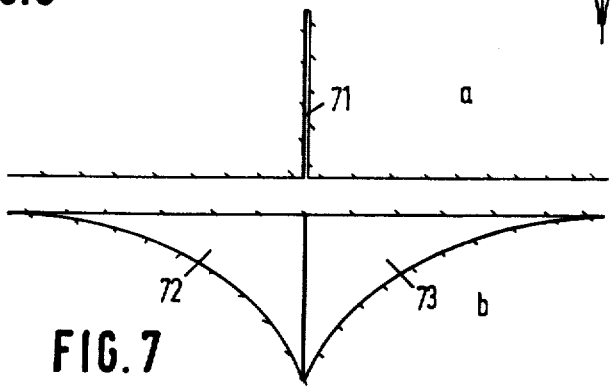
FIG. 7 shows the associated masks.

In accordance with the invention, however, the masks do not contain linear regions along which the transmission value varies but a two-dimensional region having either a transmission value 1 or a transmission value 0 at a predetermined place. Such a mask may readily be cut out of, for example, a metal sheet. The boundaries between the fully transmissive region and the non-transmissive region have the same shape as the function g(x) shown in FIG. 6. The masks halves pertaining to the function g(x) of FIG. 6 are shown in FIG. 7. Part a of FIG. 7 shows the mask pertaining to the positive portion of g(x) while part b of FIG. 7 shows the mask pertaining to the negative portion of g(x). Consequently, the mask pertaining to the positive portion of g(x) consists of a non-transmissive plate in which a transmissive slot 71 is provided. The transmissive regions of the mask pertaining to the negative portion of g(x) are indicated by 72 and 73.

The profiles are not moved past the mask in the direction corresponding with the x-axis of FIG. 6 (=the horizontal direction in FIG. 7) but in vertical direction in an orientation at right angle to the x-axis in order to carry out the convoluting operation.

It will be clear that masks of the above type may be manufactured in a highly accurate and reproducible manner.

Figure 2:
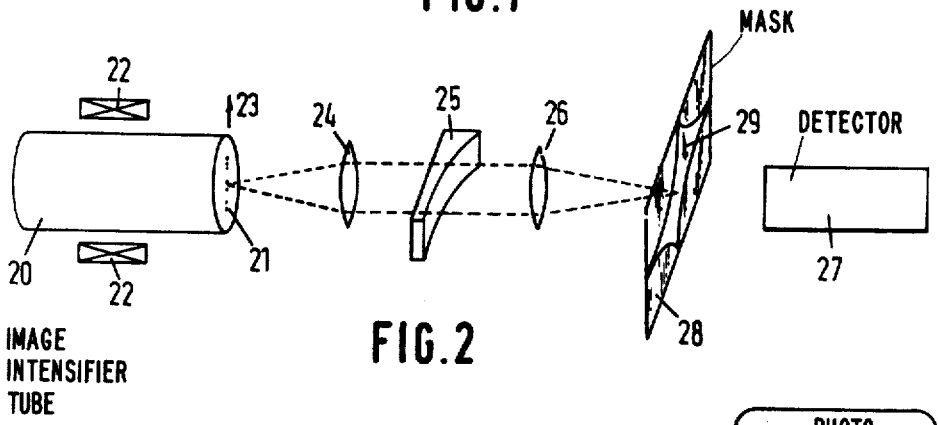
FIG. 2 schematically shows an apparatus for realizing the steps shown in FIG. 1.

FIG. 2 schematically shows an apparatus for performing the method described above. It shows an image intensifier tube 20 on the anode of which a profile 21 is optically reproduced in the manner described in U.S. application Ser. No. 795,238, filed May 9, 1977 and now U.S. Pat. No. 4,173,720. The image of the profile is moved in its longitudinal direction (see arrow 23) by means of suitably energized deflection coils 22. The resultant moving representation of the profile is applied, if necessary by means of a lens 24, to a cylindrical lens 25 forming the expanded profile. The expansion is performed in a direction transverse to the direction of arrow 23. This expanded profile is projected, if necessary by means of a suitable lens 26, onto a mask 28 representing the function g(x) in the manner described above. For the sake of clearness, the movement of the expanded profile on mask 28 is indicated by arrow 29. The moving expanded profile is detected by means of a detector 27, e.g. a photomultiplier tube. The output signal of the detector represents the result of the convolution.

In the apparatus shown in FIG. 2, the fact is ignored that function g(x) may comprise positive as well as negative portions each requiring a separate mask with associated light path and detector. Should the function g(x) comprise positive as well as negative portions indeed, a beam splitter must be interposed between the place where the expanded profile is formed and the respective masks.

Figure 3:
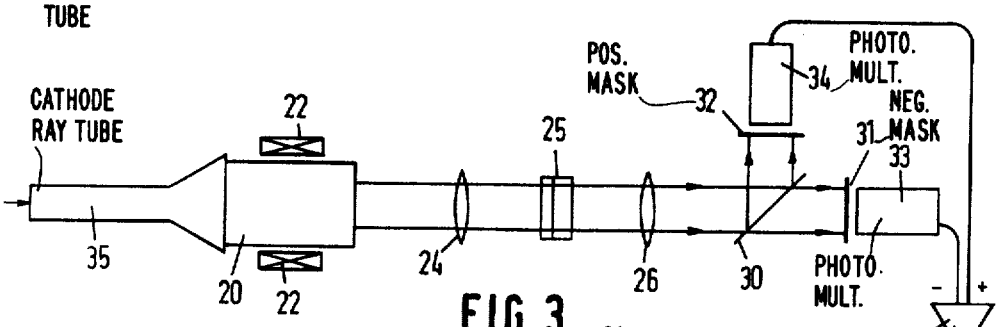
FIG. 3 shows another embodiment of an apparatus according to the invention.

Such a configuration is shown in FIG. 3, which differs from that shown in FIG. 2 as a beam splitter 30 in the form of a semitransparent mirror is interposed between, on the one hand, the cylindrical lens 25 and, if present, the lens 26 and, on the other hand, the masks.

A first mask 31 is mounted behind the beam splitter, which mask 31 represents the negative portion of the function g(x) in the embodiment shown. Mask 31 is followed by a photomultiplier tube 33 whose output signal is applied to the negative input of a differential amplifier 36.

A mask 32 is mounted in the path of the rays reflected by the semitransparent mirror 30, which mask 32 represents the positive portion of function g(x) and is followed by a photomultiplier tube 34 whose output signal is applied to the positive input of the differential amplifier 36. The output signal of this amplifier represents the result of the convoluting operation.

FIG. 3 further shows a cathode ray tube 35 to which an electric signal representing the profiles is applied, so that the profiles are successively reproduced on the screen of the cathode ray tube. This screen is optically coupled to the input window of the image intensifier tube 20.

It is observed that the beam splitting step may also be performed prior to the expansion of the profiles. In that case, however, a means for expanding the profiles is required in each light path.

Figure 4:
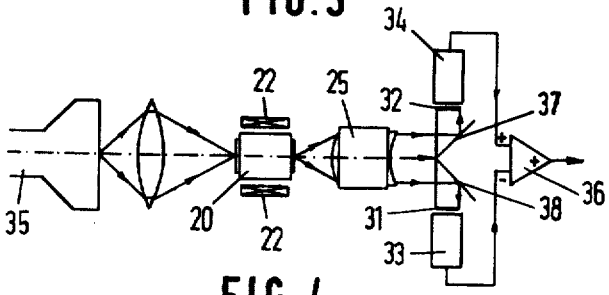
FIG. 4 shows a further embodiment of an apparatus according to the invention.

Instead of a semitransparent mirror, an assembly of two mirrors mounted at an angle relative to each other may be used for realizing the beam splitting. This variant is shown in FIG. 4. The mirrors are indicated by 37 and 38.

In accordance with a further embodiment of the invention, the use of an arrangement of mirrors as the beam splitter offers an attractive possibility to simplify an apparatus according to the invention, at any rate to give it a more compact structure. To this end, in accordance with the invention the cylindrical lens and the beam splitter are combined into a beam splitter composed of curved mirrors. In this embodiment, the curved mirrors perform the expansion of the profile as well as the beam splitting. It is observed that even if the function g(x) contains only positive or only negative portions, a curved mirror may be used instead of a cylindrical lens. In that case, in FIG. 2 the cylindrical lens 25 may be replaced by a curved mirror, the positions of the mask and the detector being adapted accordingly.

Figure 5:
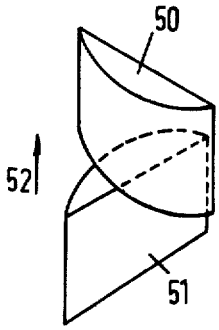
FIG. 5 shows a variant of a portion of the apparatus shown in FIG. 4.

FIG. 5 shows an arrangement of curved mirrors serving as a beam splitter as well as for expanding the profile presented. The arrangemet includes two mirrors 50 and 51 whose reflecting surfaces have the form of cylinder segments. The profile presented has the orientation indicated by arrow 52 and moves into the direction of the arrow, so that first the mask associated with the lowermost mirror 51 is exposed to the profile expanded by the mirror and subsequently the expanded profile is reflected by the uppermost mirror 50 into the direction of the mask associated with the uppermost mirror.

It is observed that the mirror configuration shown in this FIG. 5 is only one of the possible embodiments. The mirrors are at an angle relative to each other in top view. A mirror configuration in which the mirrors at an angle relative to each other in side view is feasible too, provided the mirrors expand the image in the proper direction, i.e. transverse to the direction of the profile.

Figure 8:
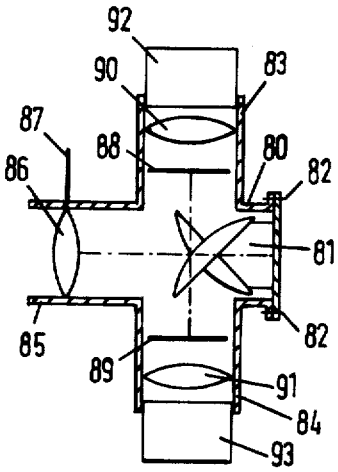
FIG. 8 shows a practical embodiment of a portion of an apparatus according to the invention.

FIG. 8 shows a practical embodiment of an apparatus for expanding and convoluting two one-dimensional functions. The apparatus comprises a housing 80 into which a support 81 having a mirror assembly as shown in FIG. 5 mounted thereon is inserted from one side and is secured in position by means of bolts 82. Tubular sections 83 extend on either side of the mounted mirrors, while a third tubular section 85 extends in front of the mirrors. Tubular section 85 is adapted to be connected in light-tight fashion to the anode of the image intensifier tube 20, so that the profiles can be projected through a focusing lens 86 provided in known per se manner with an adjusting handle 87 and through the mirrors onto the masks 88 and 89. In order to be able to adjust the lens 86 in a simple manner so that the image is projected in highly sharp focus onto the two masks 88 and 89, the support 81 with the mirror assembly mounted thereon is removed from the housing 80 and replaced by an auxiliary screen (not shown). By operating the handle 87 the lens is adjusted so that a sharp focus projection of the respective profile is achieved on this auxiliary screen. Subsequently, this auxiliary screen is replaced by the support 81 with the mirror assembly. As the distance between the point of intersection of the curved surfaces of the mirrors and the plane of the auxiliary screen is selected to be equal to the distances between this point of intersection and the masks 88 and 89, it is achieved that, when the image projected onto the auxiliary screen is in focus by adjusting the lens in the above manner, the images reflected by the mirror assembly onto the two masks will be in focus too. In this manner, the mirrors expand the profiles presented and reflect these profiles into the direction of the tubular sections 83 and 84 in which masks 88 and 89 are mounted. The light transmitted by the masks can be detected through field lenses 90 and 91 by detectors 92 and 93 mounted in the ends of tubular sections 83 and 84.

The use of the configuration of cylindrical mirrors as described above entails the following advantages: only reflection and no absorption of light energy occurs during the beam splitting and the expansion of the profiles; no cylindrical lens is required; the components may be combined in a simple manner into a light-tight device that can be adjusted from the outside; and a highly compact structure of this device is possible.

Figure 9:
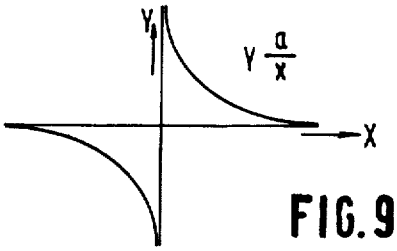
FIG. 9 shows the integrated filter function of FIG. 6.
Figure 10:
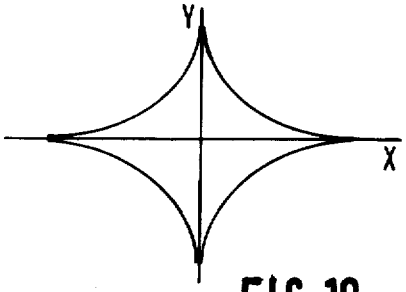
FIG. 10 shows the function of FIG. 9 mirrored relative to the y-axis, as well as the form of the associated masks.

Although a method and apparatus as described above allows the use of relatively simple masks, in some cases an even greater simplification is possible. By way of example, the function to be laid down in the masks is one having a form $y=\delta(x)-a/x^2$. The masks pertaining to this function have been described above and are shown in FIG. 7. The two masks have different forms. Integration with respect to x provides a function $y=a/x$. This function is shown in FIG. 9 and is symmetric relative to the origin. By a mirror inversion of this function relative to the y-axis, the function shown in FIG. 10 is obtained, which function is symmetric relative to the x-axis. Such a function may readily be laid down in two identical masks. The form of the transmissive regions of the masks is identical to the form of the region extending between the x-axis and the portions of the function above or below this x-axis. When using such an integrated mask function, however, a differentiated profile should be presented but this may readily be realized electronically. Due to the mirror inversion relative to the y-axis only a multiplication factor is introduced that has no additional essential importance.

It is observed that various modifications of the method and apparatus described above are obvious to the worker in the art. Such modifications are regarded to fall under the scope of the invention.

We claim:

1. A method for electro-optically convoluting a signal representing a profile formed during X-ray tomography and a filter function which comprises:

(a) electro-optically reproducing said signal as a line-shaped image having one dimension and having a brightness varying there along;

(b) converting said line-shaped image into a two-dimensional light beam having a first dimension corresponding to said one dimension and a second dimension corresponding to an expansion of said line-shaped image in a direction transverse to said one dimension;

(c) moving said two dimensional light beam in a direction corresponding to the one of said line-shaped image passed at least one mask, said mask containing regions fully transmissive or fully non-transmissive to light and representative of said filter function ; and (d) detecting light transmitted through said mask while said two-dimensional light beam is moved thereacross.

2. The method as defined in claim 1 wherein said two-dimensional light beam is passed through a beam splitter onto a first mask representative of a positive portion of said filter function and onto a second mask representative of a negative portion of said filter function.

3. The method as defined in claim 1 wherein said two-dimensional light beam is projected onto a beam splitter including two mirrors for reflection onto a first mask representative of a positive portion of said filter function and onto a second mask representative of a negative portion of said filter function.

4. The method as defined in claim 1 wherein said one-dimensional line-shaped image is expanded into a two-dimensional light beam by an optical system having at least one mirror having a surface in the shape of a portion of a cylindrical surface.

5. The method as defined in claim 4 wherein said one-dimensional line-shaped image is projected onto a beam splitter having two cylindrically-shaped mirrors for reflection onto a first mask representative of a positive portion of said filter function and onto a second mask representative of a negative portion of said filter function, each of said cylindrically-shaped mirrors expanding said line shaped-image in a direction transverse to said one dimension as said line-shaped image is scanned.

6. The method as defined in claim 5 wherein said cylindrically-shaped mirrors are positioned such that a line of intersection of the mirror surfaces thereof is parallel to the longitudinal direction of said one dimension and a generatrix of each mirror surface is parallel therewith.

7. The method as defined in claim 2, 3, 4, 5, or 6 wherein said masks are of a non-transmissive plate having an aperture therein corresponding with the region between the x-axis and a value of said filter function when said filter function is described as a function of x.

8. The method as defined in claim 7 wherein said filter function is represented in integrated form on each of said masks while said signal is presented in differentiated form.

9. An apparatus for electro-optically convoluting a signal representing a profile formed during X-ray tomography and a filter function which comprises:

electro-optical means for producing a linear image of said signal in which brightness varies along a longitudinal direction of said image;

means for converting said linear image into a corresponding light beam which is expanded in a direction transverse to said longitudinal direction thereof;

at least one mask representative of said filter function;

means for moving said light beam passed said mask;

and means for detecting light transmitted through said mask while said light beam is moved thereacross.

10. The apparatus as defined in claim 9 characterized in that the means for converting said linear image includes a cylindrical lens.

11. The apparatus as defined in claim 10 and further including at least two masks and a beam splitter succeeding said cylindrical lens for projecting said expanded linear image upon said masks.

12. The apparatus as defined in claim 11 wherein said beam splitter further comprises two mirrors mounted in juxtaposition at a predetermined angle relative to each other.

13. The apparatus as defined in claim 9 and further including a beam splitter for projecting said linear image onto at least two expanding means.

14. The apparatus as defined in claim 9 wherein said means for expanding said linear image includes at least one mirror having a surface in a shape of a cylinder segment.

15. The apparatus as defined in claim 9 wherein said means for expanding said linear image comprises two mirrors having cylindrically-shaped mirror surfaces mounted at a predetermined angle relative to each other for producing said expanded image and for acting as a beam splitter.

16. The apparatus as defined in claim 15 and including two mirrors mounted at a predetermined angle relative to each other and having mirrored surfaces in a shape of cylindrical segments.

17. The apparatus as defined in claims 12, 13, 14 or 15 wherein at least two masks are employed representing respectively the positive and negative portions of said filter function, one mask corresponding to said positive portion having a transmissive region corresponding with the region between the x-axis and the positive portion of said filter function when expressing said filter function as a function of x, the other mask corresponding to said negative portion having a transmissive region corresponding with the region between the x-axis and the negative portion of said filter function.

18. The apparatus as defined in claim 17 wherein said masks are made in accordance with a function equal to the integration of said filter function.

19. An apparatus for convoluting a signal representing a profile formed during X-ray tomography and a filter function, which comprises:

an image intensifier tube having a deflection coil, said image intensifier tube includes an anode for producing a longitudinally moving linear image of said signal in which brightness varies along said linear image.

two mirrors having surfaces and mounted at a predetermined angle relative to one another for expanding said linear image transverse to said longitudinally moving linear image and for splitting a light beam into two light beams, said surfaces being in the shape of cylindrical segments;

at least two mask means representative of a portion of said filter function in each of said two light beams;

means for detecting light transmitted through each of said mask means to produce an output signal; and differential amplifier means for receiving said output signal from said detector means and for producing an electric signal representative of convolution.

20. The apparatus as defined in claim 19 and further comprising:

a support means for mounting said mirrors at said predetermined angle relative to each other;

a housing having one end for receiving said support means and another end to be secured to said anode of said image intensifier tube; and two tubular sections for being opposedly secured to said housing adjacent each of said mirrors and in register with respective light beams reflected by said mirrors, each of said tubular sections being provided with means for securing a mask therein and with means for securing an end of each of said tubular sections to a photodetector.

21. The apparatus as defined in claims 19 or 20 wherein said two masks means are employed to represent respectively the positive and negative portions of said filter function, one mask means corresponding to said positive portion having a transmissive region corresponding with the region between the x-axis and the positive portion of said filter function when expressing said filter function as a function of x, the other mask means corresponding to said negative portion having a transmissive region corresponding with the region between the x-axis and the negative portion of said filter function.

22. The apparatus as defined in claim 21 wherein said masks are made in accordance with a function equal to the integration of said filter function.

23. A method for electro-optically convoluting a signal representing a profile formed during X-ray tomography and a filter function which comprises:

(a) electro-optically reproducing said signal as a line-shaped image having one dimension and having its brightness varying there along respectively;

(b) converting said line-shaped image into a two-dimensional light beam having a first dimension corresponding to said one dimension and a second dimension corresponding to an expansion of said line-shaped image in a direction transverse to one dimension;

(c) projecting said two dimensional light beam through a beam splitter onto a first mask representative of a positive portion of said filter function and onto a second mask representative of a negative portion of said filter function;

(d) detecting light transmitted through each mask to produce output signals herefrom; and (e) generating a difference between said output signals to produce an electric signal representative of said profile.

24. A method for electro-optically convoluting a signal representing a profile formed during X-ray tomography and a filter function which comprises:

(a) electro-optically reproducing said signal as a line-shaped image having one dimension and having its brightness varying there along respectively;

(b) converting said line-shaped image into a two-dimensional light beam having a first dimension corresponding to said one dimension and a second dimension corresponding to an expansion of said line-shaped image in a direction transverse to said one dimension;

(c) projecting said two-dimensional light beam onto a beam splitter including two mirrors for reflection onto a first mask representative of a positive portion of said filter function and onto a second mask representative of a negative portion of said filter function;

(d) detecting light transmitted through each mask to produce output signals herefrom; and (e) generating a difference between said output signals to produce an electric signal representative of said profile.

25. The method as defined in claim 23 or 24 wherein said masks are of non-transmissive plate having an aperture therein corresponding with the region between the x-axis and a value of said filter function when said filter function is described as a function of x.

26. The method as defined in claim 25 wherein said filter function is represented in integrated form on each of said masks while said signal is presented in differentiated form.

* * * * *